United States Patent [19]

Sato et al.

[11] Patent Number: 4,507,940

[45] Date of Patent: Apr. 2, 1985

[54] AIR CONDITIONING APPARATUS OF THE TYPE EMBEDDED WITHIN A CEILING

[75] Inventors: Mineo Sato; Tadaaki Kawaguchi; Yukinori Okawachi, all of Wakayama; Yasuyuki Funahashi, Kainan, all of Japan

[73] Assignee: Mitsubishi Denki Kabushiki Kaisha, Tokyo, Japan

[21] Appl. No.: 370,263

[22] Filed: Apr. 20, 1982

[30] Foreign Application Priority Data

Jul. 6, 1981 [JP] Japan ..... 56/101022

[51] Int. Cl.[3] ..... F25D 17/04

[52] U.S. Cl. ..... 62/407; 62/298; 165/122

[58] Field of Search ..... 62/259.1, 298, 407, 62/419, 404; 165/59, 54, 122

[56] References Cited

U.S. PATENT DOCUMENTS 3,417,227 12/1968 Barbier et al. ..... 165/122

*Primary Examiner*—Henry Bennett

*Attorney, Agent, or Firm*—Wenderoth, Lind & Ponack

[57] ABSTRACT

An air conditioning apparatus of the type embedded within a ceiling of a room is disclosed which is characterized in that the upper part of the main body to be installed within the ceiling is divided by a partition plate into a suction side passage and a blow-off side passage, a blower and a heat exchanger being contained in the suction and the blow-off side passages, respectively, and that mounted in the lower part of the main body is a chamber block which comprises a suction chamber in communication with the blow-off side passage and a blow-off chamber provided around the suction chamber and in communication with the blow-off side passage, the chamber block being formed of foamed resin, and that an exposed ceiling panel having suction orifices at the middle thereof and in communication with the suction chamber and blow-off orifices provided around the suction orifices and in communication with the blow-off chamber is mounted to the lower part of the chamber block.

4 Claims, 6 Drawing Figures

AIR CONDITIONING APPARATUS OF THE TYPE EMBEDDED WITHIN A CEILING

BACKGROUND OF THE INVENTION

The present invention relates to an air conditioning apparatus and more particularly to an air conditioning apparatus of the type embedded within a ceiling of a room.

Hitherto, an air conditioning apparatus of this type has usually had a construction as shown in FIG. 1 of the attached drawings. That is, in this figure the reference numeral 1 designates a main body to be arranged within a ceiling A, 2 a panel to be exposed on the surface of ceiling A and having air suction grilles 3 in its middle part and air discharge grilles 4 at both sides thereof as shown in FIG. 2, 5 a filter disposed above air suction grille 3, 6 louver means provided at air discharge orifices 4, to adjust the discharged air, 7 an inner frame body provided within main body 1 to divide it into air suction and discharge spaces inside grills 3 and 4, and *7a* and *7b* designate inner and outer air passages formed within main body 1 respectively and being in communication with air suction and discharge grills 3 and 4, whereby the air sucked from air suction grills 3 is guided upwards through inner air passage *7a* is deflected at the upper part of main body 1 and flows downwards through outer air passages *7b* formed between main body 1 and inner frame 7 to reach air discharge grills 4. A blower 8 is provided in inner air passage *7a* above air suction grilles 3, a heat exchanger 9 is provided in inner air passage *7a* above blower 8, and a condensed water pan 10 is provided between heat exchanger 9 and blower 8, whereby there are provided draft passages between blower 8 and condensed water pan 10 and between condensed water pan 10 and heat exchanger 9. A condensed water guide plate 11 is provided to guide condensed water generated in heat exchanger 9 to condensed water pan 10, and a drain orifice 12 is connected with a drain pipeline (not shown) to discharge the condensed water accumulated in condensed water pan 10 to the outside. Pipe joints 13 and 14 are provided to connect an inlet side pipeline and an outlet side pipeline (not shown) in order to supply cold or hot water to heat exchanger 9. A seal material 15 is disposed between main body 1 and exposed ceiling panel 2 to adjust the gap formed therebetween at the time of mounting and simultaneously seal against the leakage of cold or hot air circulating in inner and outer air passages *7a* and *7b*.

The conventional air conditioning apparatus of the type embedded within a ceiling having a construction such as described above has been hitherto widely used for the reasons that since air discharge grills 4 are provided at both sides of exposed ceiling panel 2 the air streams blown out through grilles 4 into the room comprise two systems, as shown in FIG. 1 by arrows, the area able to be air conditioned is made large so that comfortable air conditioning without temperature irregularity in the room is obtainable, and that, since the arrangement of air discharge grilles 4, relative to air suction grilles 3 in exposed ceiling panel 2 is symmetric, even if the air conditioning apparatus is mounted between illuminators disposed symmetrically on the ceiling surface it can be made harmoneous with the illuminators, no problem being created from the viewpoint of interior decoration, etc. However, on the other hand, the conventional air conditioning apparatus described above suffers from the following defects. That is, by disposing exposed ceiling panel 2, blower 8, condensed water pan 10 and heat exchanger 9 in order from the bottom upwards, since condensed water pan 8 is at substantially the middle of inner air passage *7a*, draft spaces have to be left between blower 8 and condensed water pan 10 and between condensed water pan 10 and heat exchanger 9, and further, since a draft space having a predetermined size is also required above heat exchanger 9 so as to deflect air from inner air passage *7a* downwards to outer air passages *7b*, the height of main body 1 must be quite large so that if the ceiling height is relatively low the air conditioning apparatus cannot be installed therein because of the height of main body 1; the construction is complicated since the apparatus is required to have inner frame body 7 in order to provide inner and outer air passages *7a* and *7b*; the air stream in inner air passage *7a* is forced to detour around condensed water pan 10 so that the draft resistance encountered in air passages *7a* and *7b* is increased, etc.

SUMMARY OF THE INVENTION

It is an object of the present invention to provide an air conditioning apparatus of the type embedded within the ceiling of a room which can eliminate all of the defects inherent to an air conditioning apparatus of the type discussed above.

It is another object of the present invention to provide an air conditioning apparatus of the type embedded within a ceiling of a room whereby the height of the main body can be made small, the heat exchange efficiency of the heat exchanger made high, and a large air conditioning capacity provided although a heat exchanger having a small heat transfer area is utilized.

It is a further object of the present invention to provide an air conditioning apparatus of the type embedded within a ceiling of a room which has an air passage of a relatively simple construction provided within the main body and has its overall dimension kept small without affecting the equalization of the temperature distribution in the room.

It is a still further object of the present invention to provide an air conditioning apparatus of the type embedded within a ceiling of a room which allows easy mounting of its exposed ceiling panel on the ceiling surface even if its main body is mounted within the ceiling high or low in accordance with the height within the ceiling.

In accordance with the present invention an air conditioning apparatus of the type embedded within a ceiling of a room is provided which comprises a main body to be installed within the ceiling, a partition plate to divide the upper part of the main body into a suction side passage and a discharge side passage, a blower contained in the suction side passage and having its discharge direction disposed at an acute angle relative to the upper wall of the main body, a heat exchanger contained in the discharge side passage and having its intake side disposed at an acute angle relative to the upper surface of the main body, and an exposed ceiling panel provided with suction orifices in communication with the suction side passage and discharge orifices in communication with the discharge side passage, whereby the plane of the end of the discharge outlet of the blower and the intake surface of the heat exchanger are at an angle to each other to form a V-shaped space therebetween.

In one of the preferred features of the present invention a chamber block is mounted in the lower part of the main body which comprises a suction chamber provided at the middle and a discharge chamber integrally secured to the suction chamber with an air passage being formed around the suction chamber.

BRIEF DESCRIPTION OF THE DRAWINGS

These and other objects of the present invention will become more readily apparent upon reading the following specification and with reference to the accompanying drawings in which.

DETAILED DESCRIPTION OF THE PREFERRED EMBODIMENT

Figure 1:
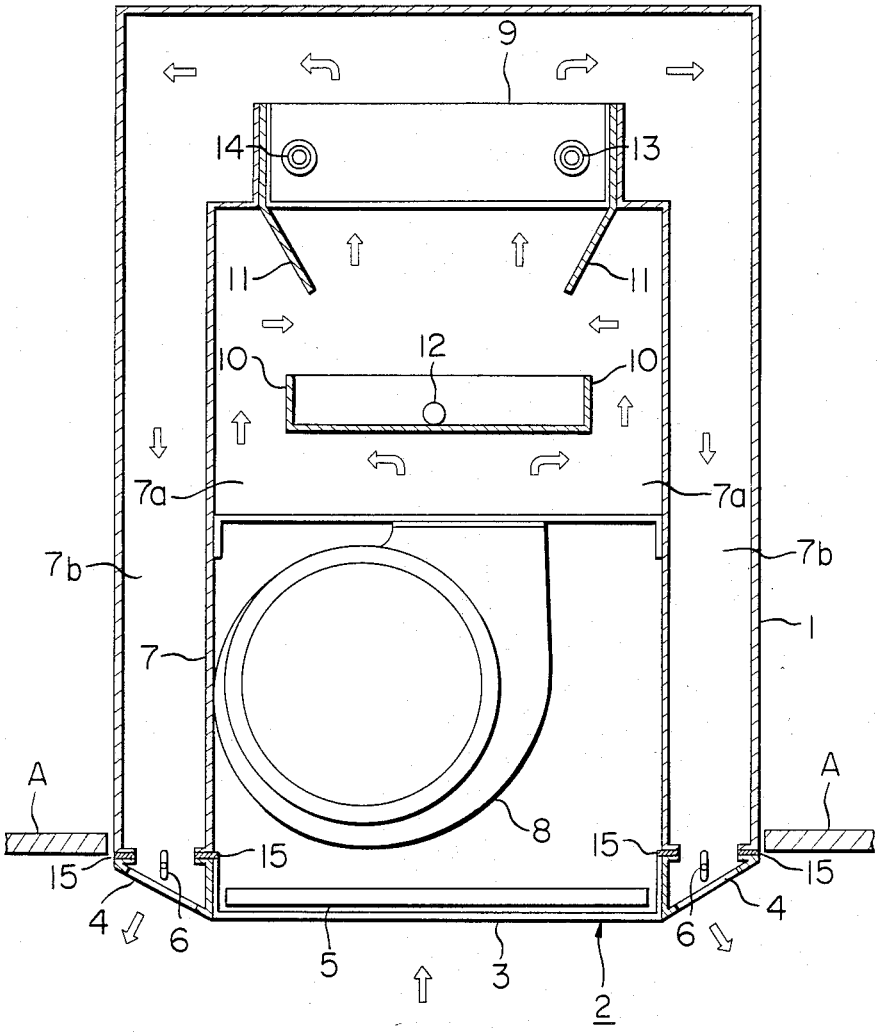
FIG. 1 is a longitudinal sectional view of a conventional air conditioning apparatus of the type embedded within a ceiling.
Figure 2:
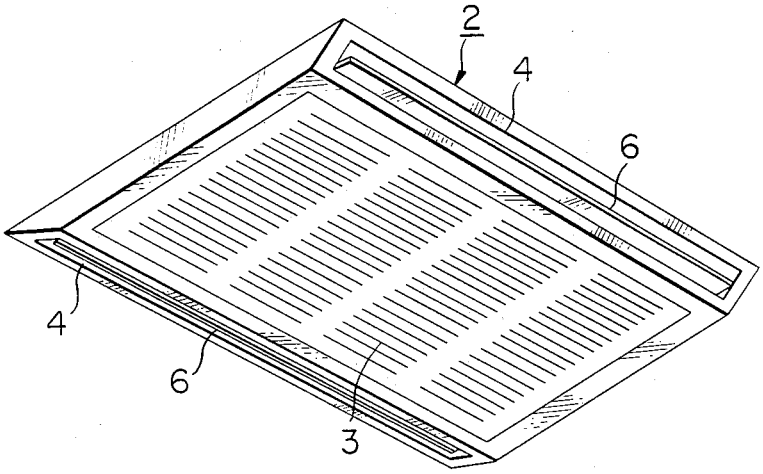
FIG. 2 is a perspective view of the exposed ceiling panel shown in FIG. 1.
Figure 3:
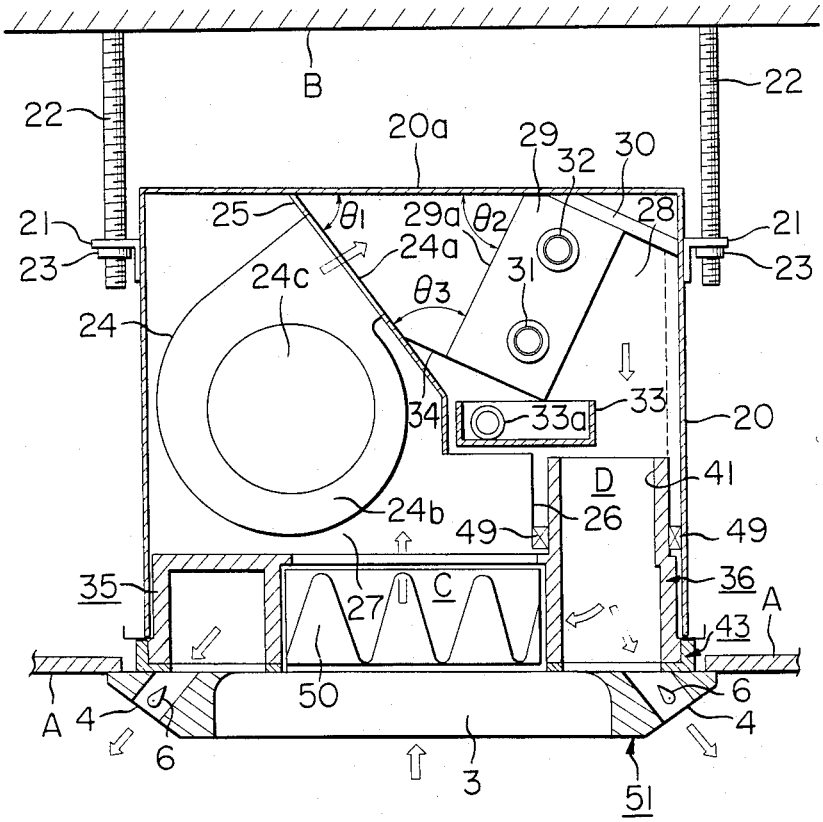
FIG. 3 is a longitudinal sectional view of one embodiment of the present invention.
Figure 4:
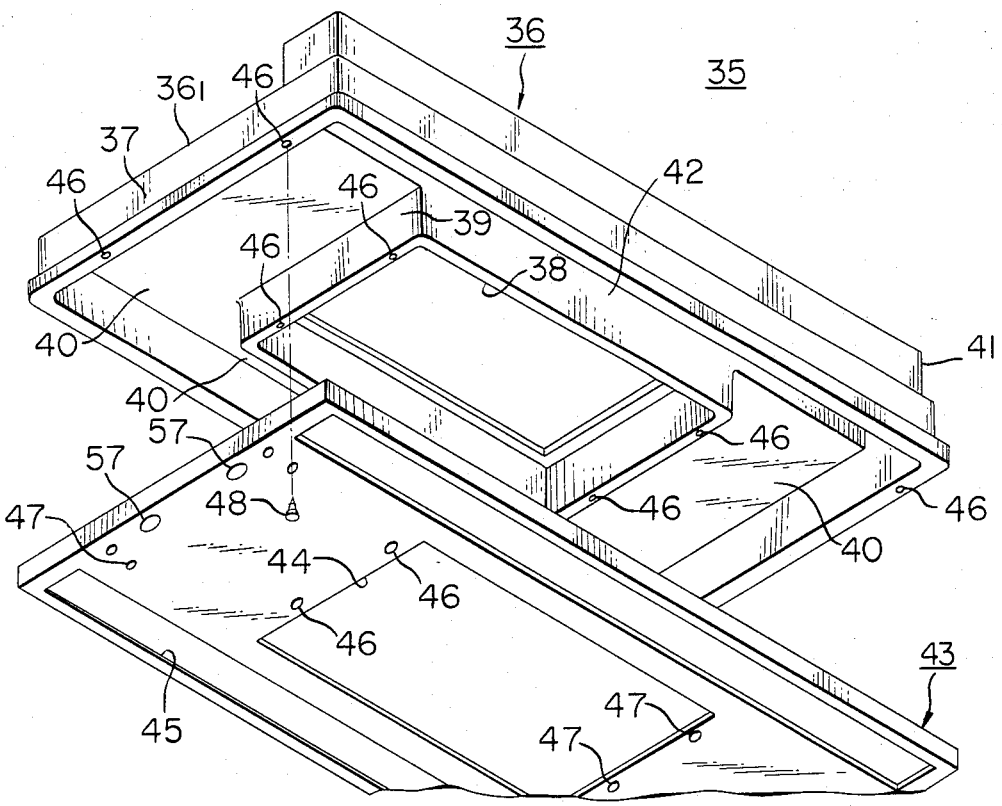
FIG. 4 is an exploded perspective view of the chamber block shown in FIG. 3.
Figure 5:
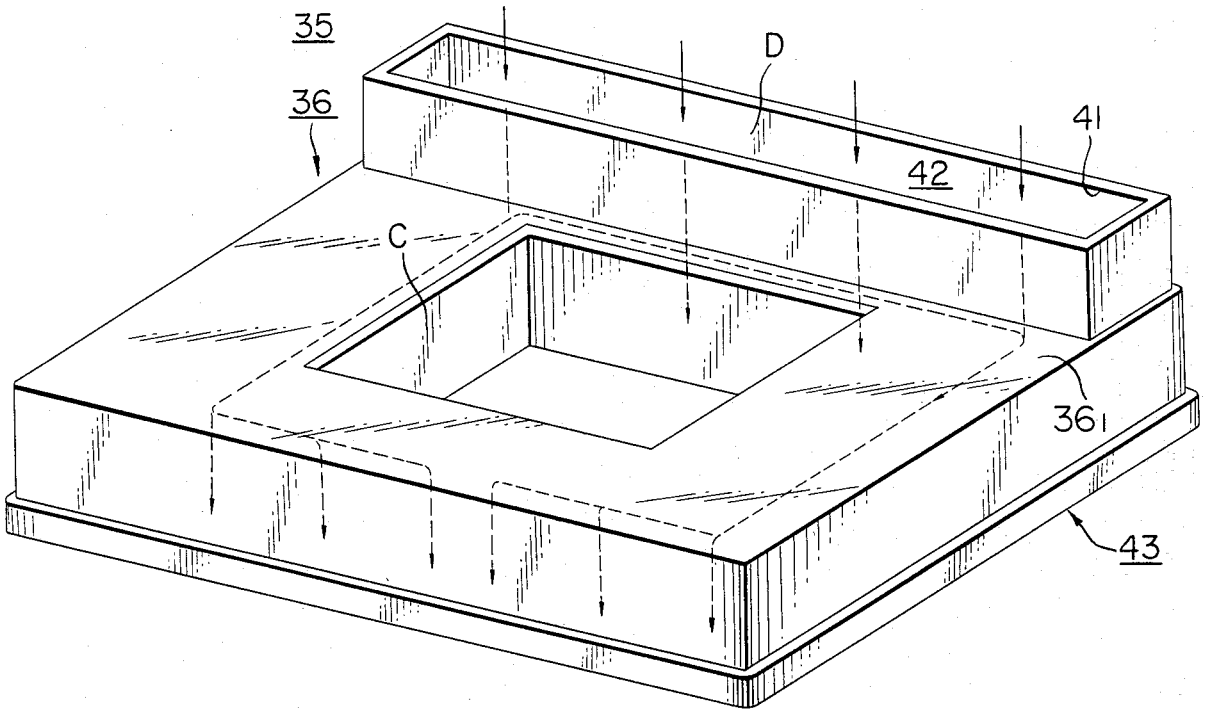
FIG. 5 is a perspective view of the chamber block shown in FIGS. 3 and 4 in the assembled state.
Figure 6:
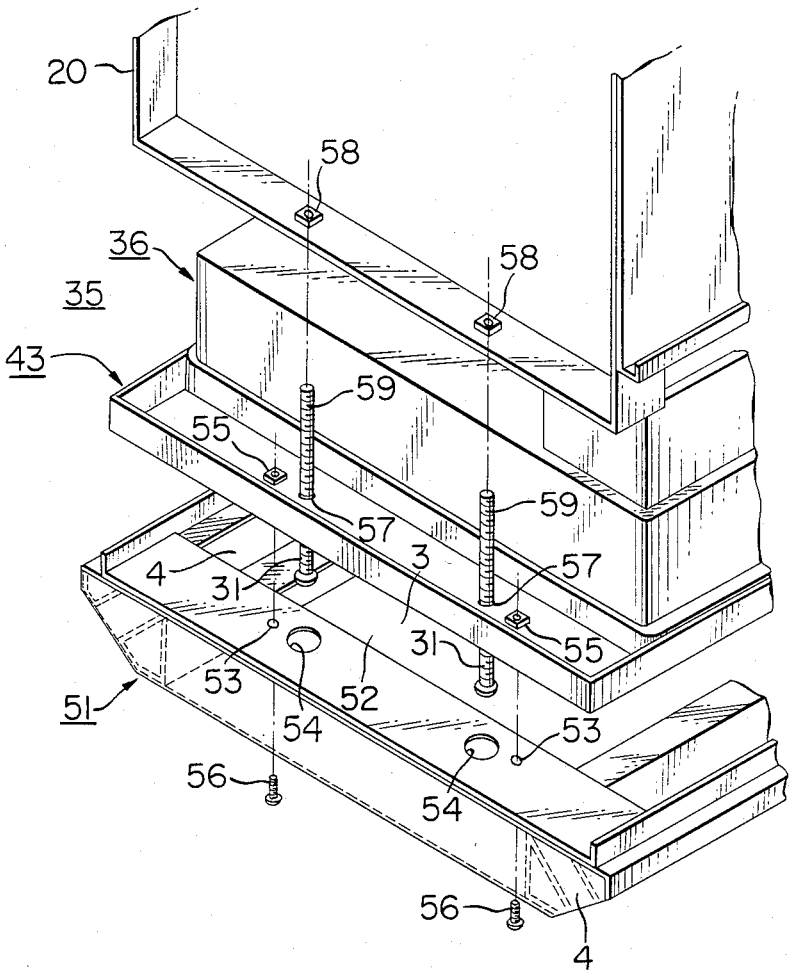
FIG. 6 is an exploded perspective view of the main body, the chamber block and the exposed ceiling panel shown in FIG. 3.

Referring now to FIG. 3 of the attached drawings, the reference numeral 20 designates a box-shaped main body to be mounted within a ceiling A, mounting fittings 21 being secured to the side plates of main body 1. Hanging bolts 22 are embedded in a ceiling slab B which are passed through mounting fittings 21, whereby the height of main body 20 to be hung within ceiling A can be adjusted by appropriately screwing nuts 23 thereonto. A blower 24 comprising a sirocco type fan is mounted within main body 20 at one side of its upper part on a blower support 25, the discharge 24*a* opening through said support 25 and the plane across the end of the discharge 24*a* thereof being at an angle $\theta$, relative to the upper wall 20*a* of main body 20, and the volute part 24*b* of the fan casing being located within main body 20. A partition plate 26 is secured to blower support 25, at one end, the blower support 25 and partition plate constituting partition means to divide the upper portion within main body 20 into a suction side passage 27 and a discharge side passage 28. A heat exchanger 29 is mounted in main body 20 on a support so as to confront the discharge 24*a* of blower 24, its intake surface 29*a* being at a predetermined angle $\theta_2$ relative to upper wall 20*a* of main body 20. Therefore, the plane across the end of discharge 24*a* of blower 24 and the intake surface 29*a* of heat exchanger 29 are at a predetermined angle $\theta_3$, e.g. 50° to 90°. An inlet 31 and an outlet 32 are provided for cold or hot water to or from heat exchanger 29, a condensed water pan 33 is arranged therebelow and having a drain exit 33*a*, and a shield plate 34 is provided to seal the gap between blower support 25 and the lower end of heat exchanger 29 and prevent the air stream blown from blower 24 from bypassing therethrough, simultaneously guiding the condensed water generated in heat exchanger 29 to condensed water pan 33. A chamber block 35 separate from main body 20 is provided and has an upper block 36 and a lower block 43 a shown in FIG. 4. More precisely, as shown in FIG. 4, upper block 36 is formed of foamed resin such as foamed styrene resin, etc., and comprises an upper wall $36_1$, an outer wall 37 having a predetermined height and surrounding the periphery thereof, a through passage 38 formed in upper wall $36_1$ centrally thereof, an inner wall 39 having the same height as that of outer wall 37 and surrounding the periphery of passage 38, an air passage 40 formed between inner and outer walls 37 and 29, an elongated air inlet passage 42 formed in upper wall 36 at one side thereof so as to be in communication with air passage 40, and an elongated air duct 41 secured to upper wall 36 so as to be aligned with air inlet passage 42. Lower block 43 is formed of sheet metal, contrary to upper block 36, serving to close air passage 40 of upper block 36, an air inlet 44 being formed centrally thereof so as to be aligned with through hole 38 of upper block 36, and air exits 45 are arranged at each side of air inlet 44 so as to be in communication with air passage 40 of upper block 36. On assembling upper and lower blocks 36 and 43, fastening screws 48 are put through screw holes 46 and 47 formed in upper and lower blocks 36 and 43, respectively, completing chamber block 35 as shown in FIG. 5. The assembled chamber block 35 is mounted as shown in FIG. 3 in main body 20 at its lower part such that it is shiftable up and down through a sealing material 49 in the exit of a discharge passage 28 formed by partition plate 26 and main body 20 with the periphery of air duct 41 acting as a guide. Therefore, there is formed a suction chamber C in through passage 38 of upper block 36 and air inlet 44 of lower block 43, and a series of air discharge chambers D is formed, each of which comprises air duct 41, air inlet passage 42, air passages 40 and air exits 45 so that the air discharged from discharge passage 28 flows as shown in FIG. 5 by the arrows. In FIG. 3 the reference numeral 50 designates a filter mounted in suction chamber C, and an exposed ceiling panel 51 is provided having substantially the same constitution as in the conventional apparatus shown in FIG. 2, but differing therefrom in the following points: as shown in FIG. 6, in the connection plate 52 of exposed ceiling panel 51 there are provided holes 53 for screws to connect it to lower block 43 of chamber block 35 and escape holes 54 to be used when connecting lower block 43 with main body 20. On connecting exposed ceiling panel 51 with lower block 43, fastening screws 56 are put into screw holes 53 and screwed into nuts 55 secured to lower block 43, so that they are integrally connected together so as to communicate blow-off chamber D of chamber block 35 with air discharge grilles 4 of exposed ceiling panel 51. After chamber block 35 has been mounted at the exit of discharge side passage 28 in the manner described above, long adjusting bolts 59 are put into escape holes 54 of exposed ceiling panel 51, holes 57 for screws of lower block 43, and nuts 58 secured to the sides of main body 20, whereby these parts are integrally assembled.

The installed position of the air conditioning apparatus thus constructed at the time of its installment within ceiling A is maintained by suspension bolts 22 and nuts 23 within ceiling A, while exposed ceiling panel 51 is adjusted as shown in FIG. 3 by tightening or loosening adjusting bolts 59 so as to bring panel 51 into abutment with the lower surface of ceiling A depending upon the height of the inside of ceiling A. In this case, although chamber block 35 is also forced to be shifted together with exposed ceiling panel 51, the seal of chamber block 35 against the exit of discharge side passage 28 is maintained by seal material 49. In air conditioning the room, the air within it is sucked through air suction grilles 3 of exposed ceiling panel 51, suction chamber C, filter 50, and suction port 24*c* of blower 24 and blown out of discharge 24*a* thereof as shown in FIG. 3 by the arrows. Since the discharged air impinges upon upper wall 20*a* of main body 20 it is uniformly supplied to heat exchanger 29 to its intake surface 29*a* so that the efficiency of heat exchanger 29 is increased. The discharged air is cooled or heated by heat exchanger 29 to be fed into discharge chamber D through discharge side passage 28 and air inlet 41, whereby the air is branched to respective air passages 40 in discharge chamber D to be blown out through respective air discharge grilles 4 of exposed ceiling panel 51, the inside of the room being uniformly air conditioned.

Thus, it will be appreciated that, in accordance with the present invention, since the plane of the discharge opening of the blower is at an acute angle relative to the upper wall of the main body and the intake surface of the heat exchanger is arranged at an acute angle relative to the upper wall of the main body so that the discharge of the blower and the intake surface of the heat exchanger are opposite each other so that a V-shape space is substantially formed therebetween, the discharged air from the blower impinges upon the upper wall of the main body, the distribution of the air stream against the intake surface of the heat exchanger being substantially equalized. Therefore, a larger capacity can be achieved in the heat exchanger, making the air conditioning apparatus small as a whole, and reducing its manufacturing cost.

Further, since there is interposed between the main body and the exposed ceiling panel the chamber block in which a suction chamber at the middle thereof is integrally formed with a discharge chamber comprising air passages around it, the construction of the air passages in the main body is simplified. Moreover, since the chamber block is formed of foamed resin its manufacture is easy, no separate heat insulating material being required at the lower part of the main body, and the equalization of the temperature in a room is by no means impaired, the whole configuration being made compact.

Further, since the chamber block is mounted on the lower part of the main body so as to be shiftable up and down and to be able is fixed at a predetermined position by adjusting means, the exposed ceiling panel can be made to be shiftable up and down. Therefore, even if the main body is installed within a ceiling high or low in accordance with the height of the inside of the ceiling, the exposed ceiling panel can be easily mounted on the lower surface of the ceiling. In this case, since the panel can be securely mounted on the under surface of the ceiling so as to be in contact therewith, it can be made to give a pleasant appearance.

Furthermore, in the case where the installation position of the main body is in the center of a room, the distance to the outside being great, and a sufficient gradient for the drain is not available, by suspending the main body high above the surface of the ceiling and spacing the chamber block from the main body as far as possible, the drain discharge position can be raised, a predetermined drain gradient being assured, and the installment made easy.

What is claimed is:

1. An air conditioning apparatus of the type for being embedded within a ceiling of a room, comprising:

a main body adapted to be mounted within a ceiling and having a horizontal top wall and substantially vertical side walls;

a partition means in the upper part of said main body dividing said upper part into a suction passage in the center and on one side of said main body and a single discharge passage on the other side of said main body;

a blower means contained in said suction passage and having the discharge thereof opening through said partition means, the discharge being angled upwardly with the plane across the end of the discharge being at an angle to said top wall;

a heat exchanger means contained in said discharge passage and positioned laterally in a horizontal direction from said blower means, the intake side thereof facing diagonally upwardly toward said blower means and forming a V with said plane across the end of said discharge of said blower means;

an annular chamber around the periphery of the lower part of said main body having the central opening thereof in communication with said suction passage and having the chamber in communication with said single discharge passage; and an exposed ceiling panel on the bottom of said annular passage having suction orifices at the middle thereof in communication with said central opening and discharge openings in communication with said annular chamber.

2. An air conditioning apparatus as claimed in claim 1 wherein said annular chamber is made of foamed resin.

3. An air conditioning apparatus as claimed in claim 1 wherein said annular chamber is adjustably mounted on the lower part of said main body so as to be adjustable upwards and downwards relative thereto.

4. An air conditioning apparatus as claimed in claim 1 wherein the angle of said V between said discharge of said blower means and said intake side of said heat exchanger is from 50° to 90°.

* * * * *